US008175314B1

(12) United States Patent
Webster

(10) Patent No.: US 8,175,314 B1
(45) Date of Patent: May 8, 2012

(54) TACTICAL MICROPHONE SUPPORT SYSTEMS

(76) Inventor: Brian E. Webster, Scottsdale, AZ (US)

( * ) Notice: Subject to any disclaimer, the term of this patent is extended or adjusted under 35 U.S.C. 154(b) by 960 days.

(21) Appl. No.: 12/176,977

(22) Filed: Jul. 21, 2008

Related U.S. Application Data

(60) Provisional application No. 60/950,926, filed on Jul. 20, 2007, provisional application No. 61/036,860, filed on Mar. 14, 2008.

(51) Int. Cl.

| | |
|---|---|
| ***H04R 3/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/364; 381/122

(58) Field of Classification Search ..... 381/122, 381/364

See application file for complete search history.

(56) References Cited

U.S. PATENT DOCUMENTS

| | | | | |
|---|---|---|---|---|
| 1,932,581 | A | 10/1933 | Gilman | |
| 2,085,184 | A | 6/1937 | Carlisle | |
| 2,505,551 | A | 4/1950 | Knowles | |
| 2,616,985 | A | 11/1952 | Levy | |
| 3,586,798 | A | 6/1971 | Holmes | |
| 3,604,069 | A | 9/1971 | Jensen | |
| 3,808,642 | A | 5/1974 | Nation | |
| 4,040,547 | A | 8/1977 | Dickey | |
| 4,100,653 | A | 7/1978 | Sensabaugh | |
| 4,700,397 | A | 10/1987 | Zimmermann et al. | |
| 5,163,093 | A | 11/1992 | Frielingsdorf et al. | |
| 5,268,965 | A | 12/1993 | Badie et al. | |
| 5,752,632 | A * | 5/1998 | Sanderson et al. | 224/182 |
| 5,771,303 | A | 6/1998 | Mazzarella et al. | |
| 5,806,146 | A | 9/1998 | Chen | |
| 5,831,198 | A | 11/1998 | Turley et al. | |
| 5,850,613 | A * | 12/1998 | Bullecks | 455/569.1 |
| 6,149,043 | A | 11/2000 | Goto | |
| 6,201,877 | B1 | 3/2001 | Chang | |
| 6,283,348 | B1 * | 9/2001 | Wang | 224/271 |
| 6,333,984 | B1 | 12/2001 | Yang | |
| 6,757,401 | B2 | 6/2004 | Uchimura et al. | |
| 7,013,492 | B2 | 3/2006 | Hugh et al. | |
| 7,784,157 | B1 * | 8/2010 | Short et al. | 24/3.13 |
| 2002/0030071 | A1 | 3/2002 | Griffiths | |
| 2004/0069823 | A1 * | 4/2004 | Condiff | 224/269 |
| 2008/0078792 | A1 * | 4/2008 | Tages | 224/271 |
| 2008/0164291 | A1 * | 7/2008 | Goradesky et al. | 224/269 |
| 2008/0237282 | A1 * | 10/2008 | Sin | 224/197 |
| 2008/0305840 | A1 * | 12/2008 | Lin | 455/575.1 |
| 2010/0018015 | A1 * | 1/2010 | Moore | 24/586.11 |
| 2010/0270345 | A1 * | 10/2010 | Kecskes | 224/269 |

* cited by examiner

*Primary Examiner* — Victor A Mandala
(74) *Attorney, Agent, or Firm* — Stoneman Law Patent Group; Martin L. Stoneman; Eric Fish

(57) ABSTRACT

A tactical microphone support system to attach a tactical microphone to a law enforcement uniform and keep it supported in place, particularly when a law enforcement officer is being physically active, such as, for example, while pursuing a suspect. Preferably, the tactical microphone support attaches to at least one button on a law enforcement shirt. The tactical microphone support provides for center, right or left handed attachment.

27 Claims, 7 Drawing Sheets

TACTICAL MICROPHONE SUPPORT SYSTEMS

CROSS-REFERENCE TO RELATED APPLICATION

The present application is related to and claims priority from prior provisional application Ser. No. 60/950,926, filed Jul. 20, 2007, entitled "TACTICAL MICROPHONE KEEPER," and is related to and claims priority from prior provisional application Ser. No. 61/036,860, filed Mar. 14, 2008, entitled "TACTICAL MICROPHONE SUPPORT," the contents of both of which are incorporated herein by this reference and are not admitted to be prior art with respect to the present invention by the mention in this cross-reference section.

BACKGROUND

This invention relates to providing a support system for attaching a communication device to a portion of clothing. More particularly, this invention relates to providing a tactical microphone support system relating to law enforcement officer tactical microphones supported by such officer uniforms. Tactical microphones are communication devices often used in law enforcement for 2-way conversations between law enforcers and/or other entities working with such law enforcers. Tactical microphones often comprise a base unit with an attached microphone. Such microphones have an attaching clip on the rear portion that may be directly attached to a portion of the user's uniform, typically the epaulet (along the shoulder of many uniforms). The problem with current clip attachment is that during an active pursuit, such as, for example, while running or apprehending a suspect, the microphone is often dislodged and falls away from the officer, causing the user to not have access to critical communication with other law enforcement personnel and potentially damaging the microphone. It would be highly useful to have a system for maintaining support, and attachment to the uniform, of the microphone even during active pursuits.

OBJECTS AND FEATURES OF THE INVENTION

A primary object and feature of the present invention is to provide a system overcoming the above-mentioned problem.

It is another object and feature of the present invention to provide such a system to assist tactical microphone coupling with a law enforcement uniform.

It is another object and feature of the present invention to provide such a system to assist tactical microphone coupling with a law enforcement shirt button.

It is a further object and feature of the present invention to provide such a system for maintaining support, and attachment to the uniform, of the microphone even during active pursuit.

It is another object and feature of the present invention to provide such a system wherein a user may operate, connect and disconnect a tactical microphone using only one hand.

A further primary object and feature of the present invention is to provide such a system that is efficient, inexpensive, and handy. Other objects and features of this invention will become apparent with reference to the following descriptions.

SUMMARY OF THE INVENTION

In accordance with another preferred embodiment hereof, this invention provides a communication device support apparatus comprising: at least one support to support at least one communication device; and at least one hanger to hang such at least one support from at least one normally usable button wearable by at least one communication device support user; wherein such at least one hanger comprises at least one substantially rigid slot having at least one upper portion supportable by such at least one button wearable by such at least one communication device support user.

Moreover, it provides such a communication device support apparatus wherein such at least one substantially rigid slot comprises at least one bayonet slot adapted to bayonet lock such at least one hanger to such at least one normally usable button wearable by the at least one communication device support user. Additionally, it provides such a communication device support apparatus wherein such at least one bayonet slot comprises a single about L-shaped slot structured and arranged to bayonet lock such at least one normally usable button. Also, it provides such a communication device support apparatus further comprising: the at least one communication device; wherein such at least one communication device comprises at least one microphone; and wherein such at least one microphone comprises at least microphone coupler element.

In addition, it provides such a communication device support apparatus wherein the at least one communication device comprises at least one communication element of at least one law enforcement tactical two-way radio. And, it provides such a communication device support apparatus wherein such at least one substantially rigid slot comprises at least one blocking element structured and arranged to block outlet passage of such at least one normally usable button when engaged by such at least one substantially rigid slot. Further, it provides such a communication device support apparatus wherein such at least one bayonet slot comprises at least one blocking element structured and arranged to block outlet passage of such at least one normally usable button when engaged by such at least one bayonet slot. Even further, it provides such a communication device support apparatus wherein such at least one support comprises a plurality of coupling elements onto which such at least one microphone coupler element may be coupled to.

Moreover, it provides such a communication device support apparatus wherein such at least one support comprises at least three apertures structured and arranged to couple to such at least one microphone element. Additionally, it provides such a communication device support apparatus wherein such at least three apertures are structured and arranged to provide for center, right, or left attachment of such at least one communication device to such at least one support. Also, it provides such a communication device support apparatus wherein such at least one support comprises at least one arcuate faceplate. In addition, it provides such a communication device support apparatus wherein such at least one blocking element comprises at least one raised convex bump. And, it provides such a communication device support apparatus wherein such at least one raised convex bump is situate below such at least one upper portion and closely adjacent such at least one bayonet slot. Further, it provides such a communication device support apparatus wherein a user may operate, connect, and disconnect such at least one microphone using only one hand.

Even further, it provides such a communication device support apparatus wherein such at least one bayonet slot comprises at least one blocking element structured and arranged to block outlet passage of such at least one normally usable button when engaged by such at least one bayonet slot.

In accordance with another preferred embodiment hereof, this invention provides a communication device support apparatus comprising: at least one hanger having at least one upper slot end on at least one substantially vertical rigid slotted portion; wherein such at least one hanger comprises at least one microphone attachable element below such at least one substantially vertical rigid slotted portion; and wherein such at least one hanger is hangable on such at least one normally usable button of a wearable clothing article at such upper slot end; whereby at least one portable microphone may be attached in at least one user-selected position to such at least one microphone attachable element.

In accordance with another preferred embodiment hereof, this invention provides a method of attaching at least one portable microphone, in at least one user-selected position to at least one normally usable button on such user's clothing, comprising the steps of: providing at least one hanger having at least one upper slot end on at least one substantially vertical rigid slotted portion and at least one microphone attachable element below such at least one substantially vertical rigid slotted portion; hanging such at least one hanger on such at least one normally usable button on such user's clothing at such upper slot end; and attaching a portable microphone to such at least one microphone attachable element.

In accordance with another preferred embodiment hereof, this invention provides a communication device support apparatus comprising: at least one portable microphone, attachable in at least one user-selected position to at least one normally usable button on at least one wearable clothing article; and at least one hanger having at least one upper slot end on at least one substantially vertical rigid slotted portion, wherein such at least one hanger comprises at least one microphone attachable element below such at least one substantially vertical rigid slotted portion; wherein such at least one hanger is hangable on such at least one normally usable button on such at least one wearable clothing article at such upper slot end; and wherein such at least one portable microphone is attached to such at least one microphone attachable element. Even further, it provides such a communication device support apparatus wherein a user may operate, connect and disconnect such at least one microphone using only one hand.

In accordance with another preferred embodiment hereof, this invention provides a communication device support apparatus comprising: support means for supporting at least one communication device; and hanger means for hanging such support means from at least one normally usable button wearable by at least one communication device support user; wherein such hanger means comprises substantially rigid slot means having at least one upper portion supportable by gravity behind such at least one button wearable by such at least one communication device support user.

In accordance with another preferred embodiment hereof, this invention provides a communication device support apparatus comprising: support means for supporting at least one clip-on tactical microphone; and support hanger means for hanging such support means from at least one clothing appendage normally wearable by at least one communication device support user; wherein such support means comprises clip hanger means for receiving at least one tactical microphone clip; and wherein such clip-hanger means comprises aperture means for permitting at least one support end of such at least one tactical microphone clip to fully close; and geometry means for permitting the at least one tactical microphone clip to be clipped from at least two sides of such aperture means. Even further, it provides such a communication device support apparatus wherein such at least one clothing appendage comprises at least one button. Even further, it provides such a communication device support apparatus wherein such at least one clothing appendage comprises at least one epaulette. Even further, it provides such a communication device support apparatus wherein such at least one clothing appendage comprises at least one belt.

In accordance with another preferred embodiment hereof, this invention provides a communication device support apparatus comprising: at least one support adapted to support at least one clip-on tactical microphone; and at least one support-hanger to hang such at least one support from at least one clothing appendage normally wearable by at least one communication device support user; wherein such at least one support comprises at least one clip-hanger structured and arranged to receive at least one tactical microphone clip; and wherein such at least one clip-hanger comprises at least one aperture adapted to permit at least one support end of such at least one tactical microphone clip to fully close; and at least one geometry structured and arranged to permit the at least one tactical microphone clip to be clipped from at least two sides of such at least one aperture. Even further, it provides such a communication device support apparatus wherein such at least one clothing appendage comprises at least one button. Even further, it provides such a communication device support apparatus wherein such at least one clothing appendage comprises at least one epaulette. Even further, it provides such a communication device support apparatus wherein such at least one clothing appendage comprises at least one belt.

DETAILED DESCRIPTION OF THE BEST MODES AND PREFERRED EMBODIMENTS OF THE INVENTION

Figure 1:
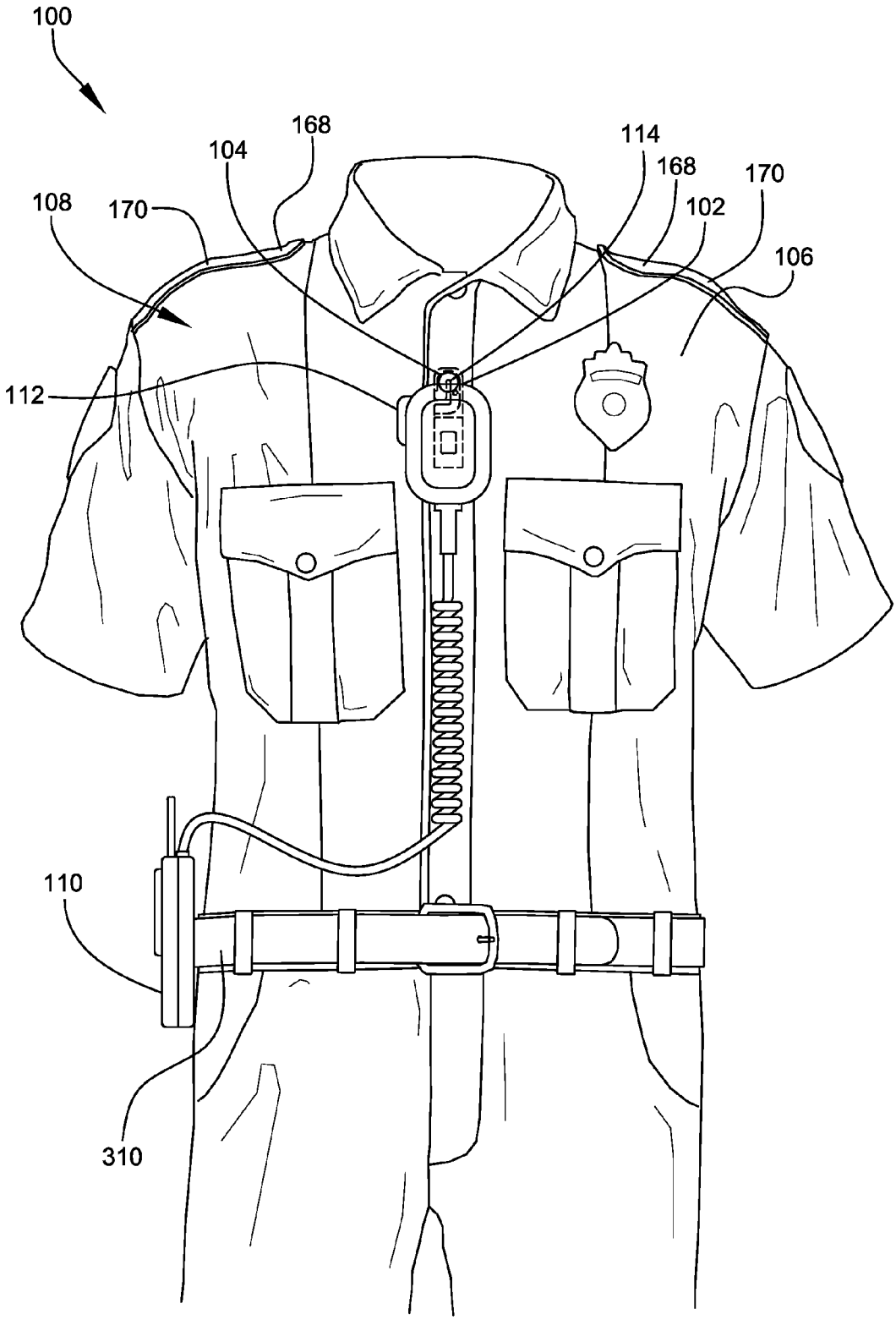
FIG. 1 shows a perspective view, illustrating the tactical microphone support system, according to a preferred embodiment of the present invention.

FIG. 1 shows a perspective view, illustrating the tactical microphone support system, according to a preferred embodiment 100 of the present invention. Preferably, preferred embodiment 100 of the tactical microphone support system comprises at least one microphone support 102, as shown. Preferably, the tactical microphone support system assists a tactical microphone 112 to remain supported in place, particularly when a law enforcement officer is being physically active, such as, for example, while pursuing a suspect. Preferably, microphone support 102 attaches and hangs from at least one normally usable button 104 on at least one shirt 106, preferably a law enforcement uniform 108, preferably comprising reinforced buttons 104, preferably attached to shirt 106 with heavy duty stitching 114, as shown. Highly preferably, the second button from the top of shirt 106 is preferred to hang the microphone support from, as shown. Upon reading this specification, those with ordinary skill in the art will now appreciate that, under appropriate circumstances, considering such issues as user preference, uniform distinctions, button technology, cost, structural requirements, available materials, etc., other button types and reinforcing such as, for example, metallic buttons, riveted buttons, etc., may suffice.

Figure 5:
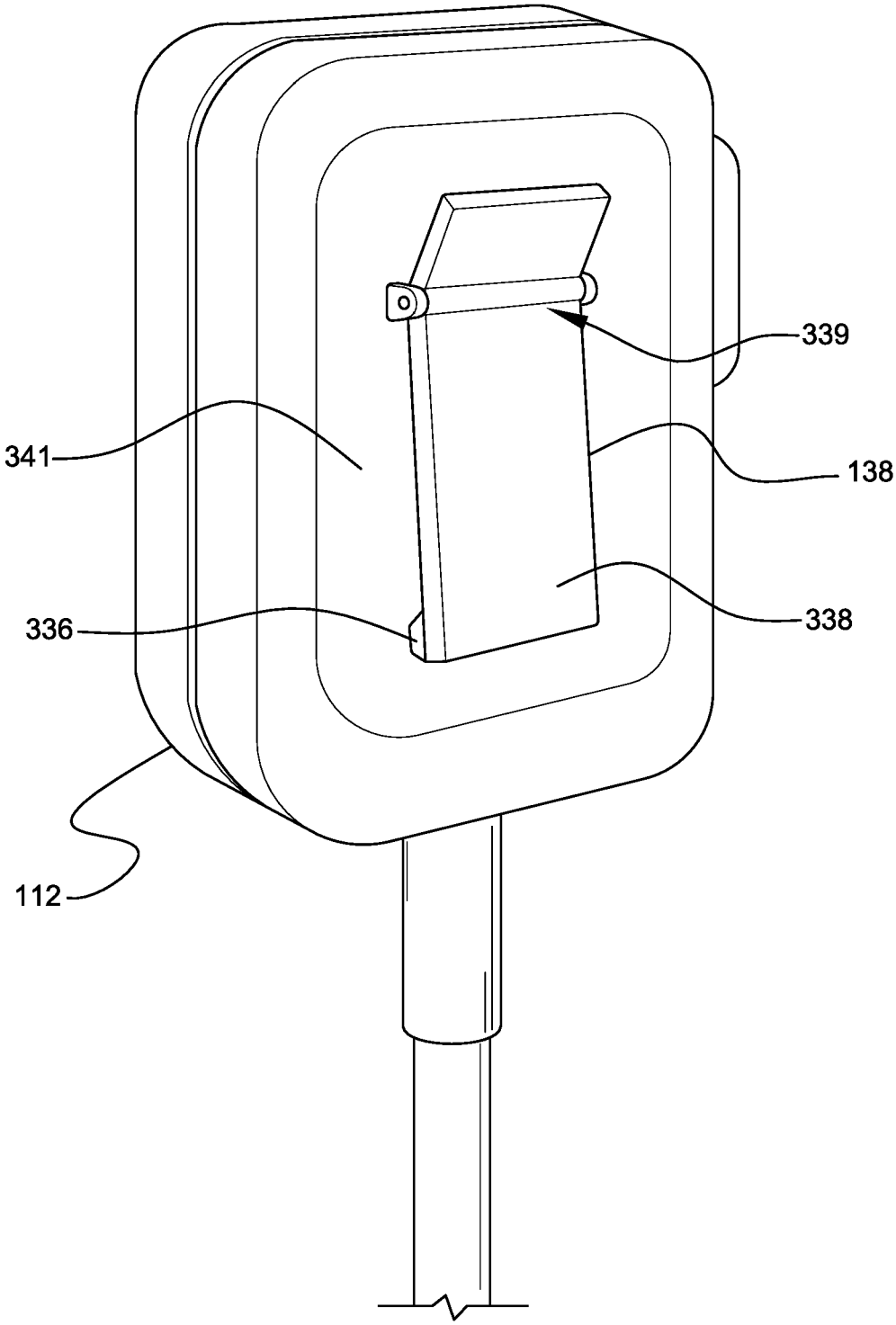
FIG. 5 shows a perspective view, illustrating a tactical microphone and rear coupling, according to the preferred embodiment of FIG. 1.

Law enforcement personnel, particularly field officers such as, for example, police, sheriffs, highway patrol, immigration, federal and state law enforcement, etc., carry two-way radio communication with an attached microphone. FIG. 1 illustrates one style of two-way radio 110 and tactical microphone 112, as shown; other styles of tactical microphones, such as those having a swivel coupler, fixed coupler, etc., may also preferably be utilized with microphone support 102. Preferably, microphone support 102 supports at least one such tactical microphone 112, as shown. Preferably, tactical microphone 112 couples to microphone support 102, preferably with a rear coupler 138, (for example, as shown in FIG. 5, a spring-tensioned clip that is spring tension-closed until such time a user causes a force against such spring tension to release the coupler), preferably positioning tactical microphone 112 so that such law enforcement personnel (herein after also referred to simply as officer) may easily utilize tactical microphone 112, preferably with a single hand motion by the officer. Upon reading this specification, those with ordinary skill in the art will now appreciate that, under appropriate circumstances, considering such issues as user preference, law enforcement authority distinctions, microphone technology improvements, cost, communication requirements, available materials, etc., other microphone types and ancillary features such as, for example, hands-free microphones, voice recognition, etc., may suffice.

Figure 2:
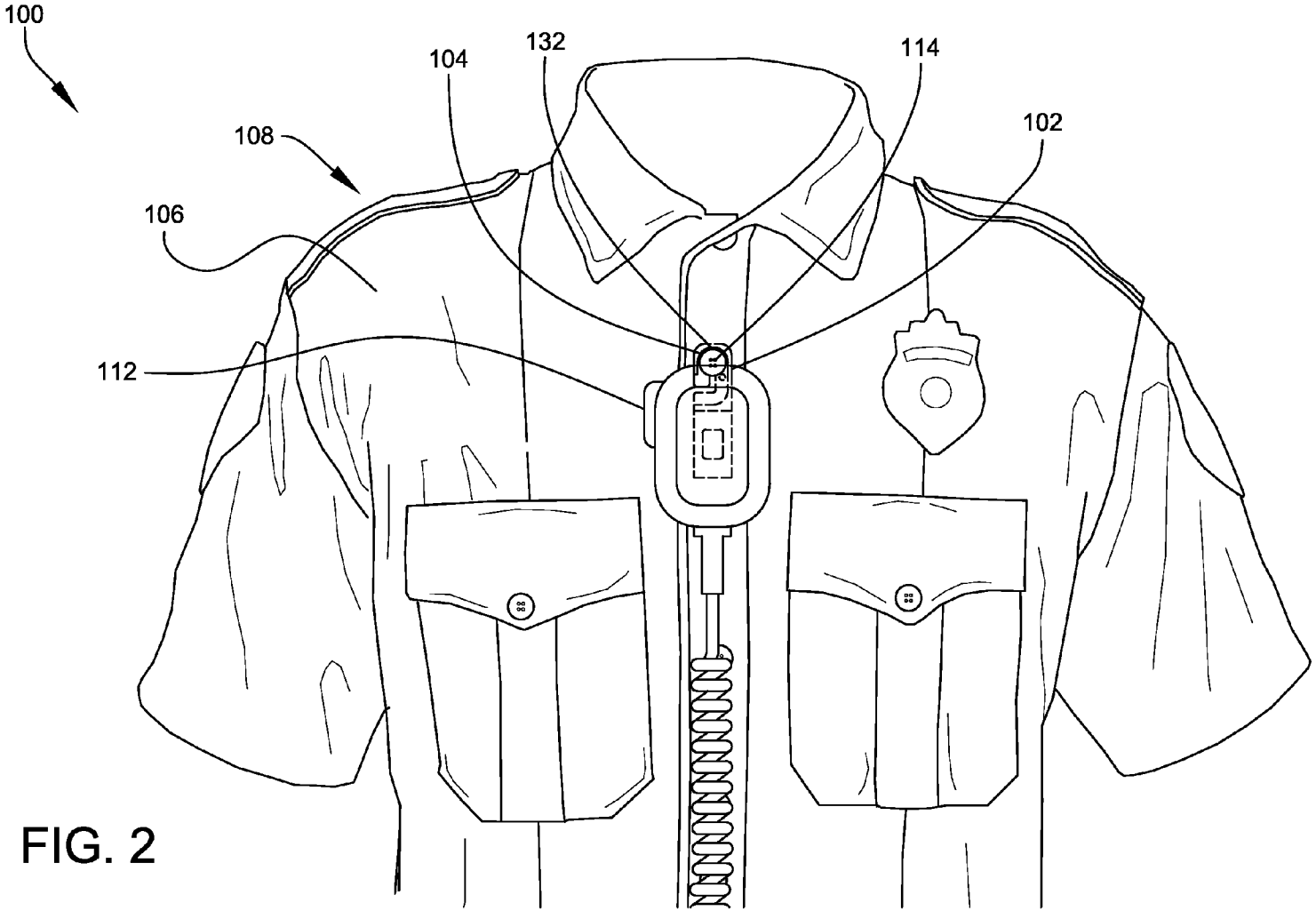
FIG. 2 shows an enlarged view of FIG. 1, illustrating the tactical microphone support system, according to the preferred embodiment of FIG. 1.
Figure 3:
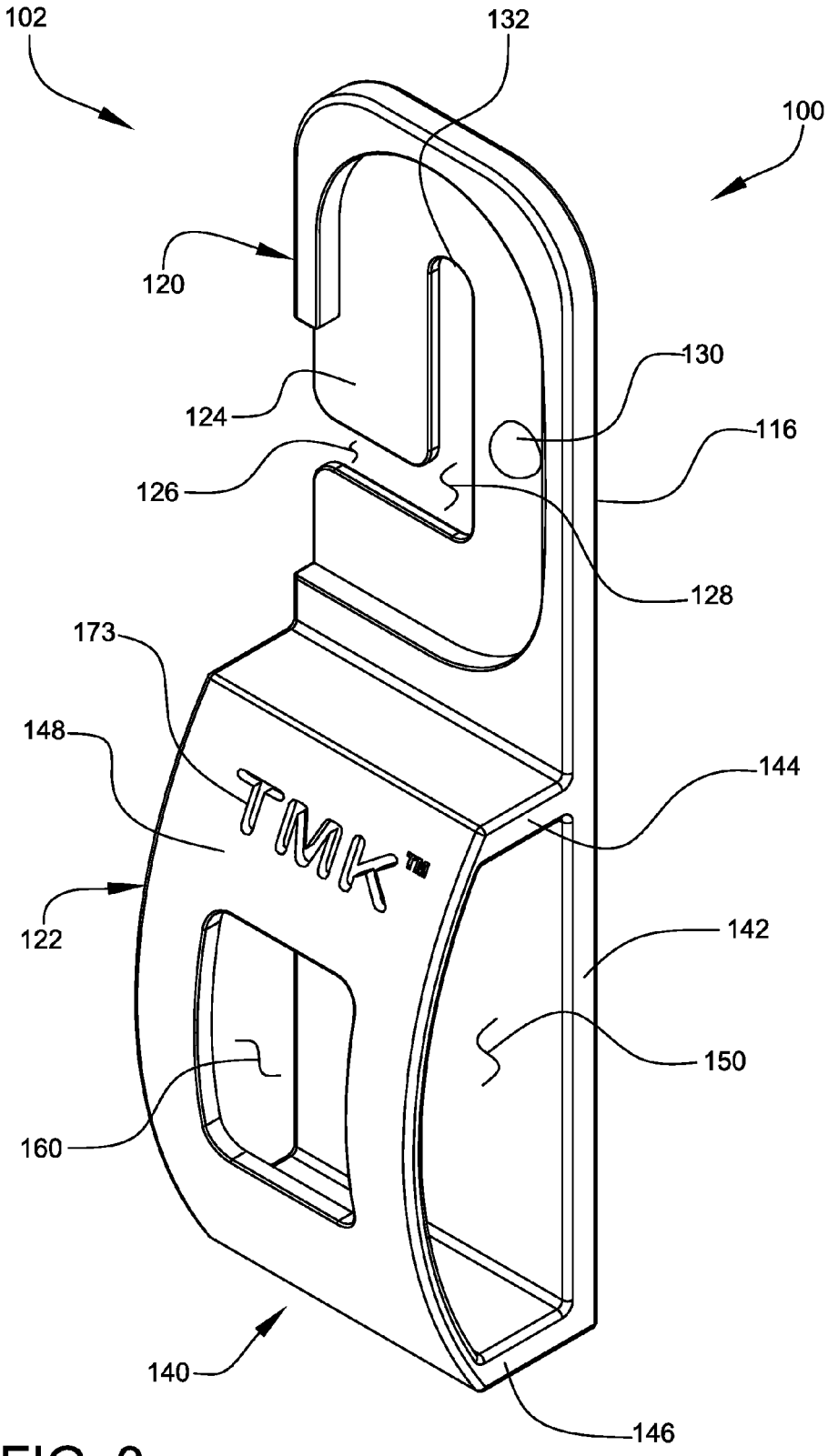
FIG. 3 shows a perspective view, illustrating the tactical microphone support, according to the preferred embodiment of FIG. 1.
Figure 4:
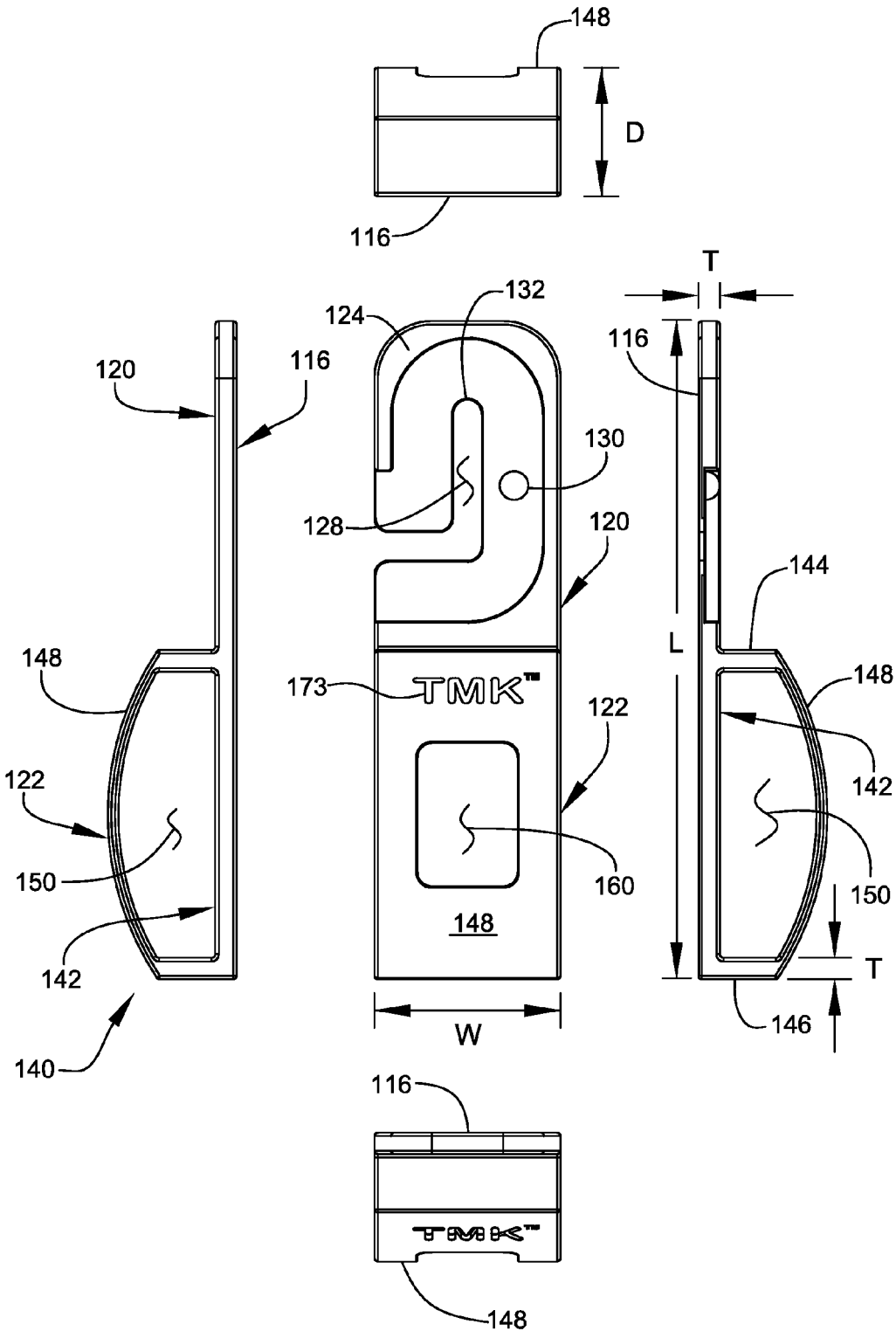
FIG. 4 shows orthographic projected views, illustrating the front, top, bottom, left, and right orthographic projected views of the tactical microphone support according to the preferred embodiment of FIG. 3.

FIG. 2 shows an enlarged view of FIG. 1, illustrating the tactical microphone support system, according to the preferred embodiment of FIG. 1. FIG. 3 shows a perspective view, illustrating the tactical microphone support 102, according to the preferred embodiment of FIG. 1. FIG. 4 shows orthographic projected views, illustrating the front, top, bottom, left, and right orthographic projected views of the tactical microphone support according to the preferred embodiment of FIG. 3. FIG. 5 shows a perspective view, illustrating a tactical microphone and rear coupling, according to the preferred embodiment of FIG. 1.

Preferably, microphone support 102 comprises at least one back portion 116, preferably a single-piece flat back, as shown. Preferably, back portion 116 is about 2¾ inches in length L and about 13/16 inch in width W, about 9/16 inch in depth D with a preferred material thickness T of about ¼ inch (See FIG. 4). Upon reading this specification, those with ordinary skill in the art will now appreciate that, under appropriate circumstances, considering such issues as user preference, law enforcement uniform distinctions, microphone technology improvements, microphone size, cost, communication requirements, structural requirements, available materials, etc., other dimensions for width and length, non-planar back, etc., may suffice.

Preferably, microphone support 102 further comprises at least one upper portion 120 and at least one lower portion 122, as shown. Preferably, upper portion 120 comprises at least one recessed portion 124. Preferably, the recessed portion is at least the depth of button 104 so that when button 104 is engaged in slot 126, button 104 does not protrude from the recessed portion 124. Preferably, recessed portion 124 comprises at least one slot 126, preferably a rigid slot, preferably substantially smaller than the diameter of button 104, highly preferably a single bayonet slot 128, preferably comprising about an L-shaped slot, as shown. Preferably, situate adjacent bayonet slot 128 is button stop 130, as shown. Preferably, button stop 130 comprises at least one raised, convex, round protrusion having a diameter of about ⅛ to about ¼ inch at the base and being raised about the thickness of button 104, preferably about ⅛ inch. Upon reading this specification, those with ordinary skill in the art will now appreciate that, under appropriate circumstances, considering such issues as cost, structural requirements, available materials, etc., other button stops may suffice. Preferably, button stop 130 is structured and arranged as described and shown to block passage of button 104 when button 104 is fully engaged in the bayonet slot 128, so that button 104 is blocked from outward passage through bayonet slot 128, as shown.

Preferably, in operation, a user may mechanically pass button 104 past button stop 130 as button 104 is placed into bayonet slot 128. In such operation, a user preferably slightly twists button 104 at an angle of about 45-degrees to button stop 130, so that button stop 130 will not hinder passage of button 104 past button stop 130 when inserting button 104 into bayonet slot 128 and through to the end 132 of bayonet slot 128, as shown. Preferably, when microphone support 102 is hanging (by gravity) vertically from button 104, button 104 will be blocked from passing button stop 130, even under heavy movement by the user, thereby assisting the bayonet slotting to keep the microphone support 102 (and tactical microphone 112 when attached to such microphone support) attached to shirt 106, as shown (at least embodying herein wherein such at least one hanger comprises at least one substantially rigid slot having at least one upper portion supportable by gravity behind such at least one button wearable by such at least one communication device support user; and, at least embodying herein wherein such hanger means comprises substantially rigid slot means having at least one upper portion supportable by gravity behind such at least one button wearable by such at least one communication device support user). Upon reading this specification, those with ordinary skill in the art will now appreciate that, under appropriate circumstances, considering such issues as user preference, law enforcement uniform distinctions, microphone technology improvements, microphone size, bayonet slot size, cost, available materials, etc., other means for securing the button within the slot, such as, for example, slidable pin stops, multiple in-line pins, button clips, serpentine slots, etc., may suffice.

Preferably, lower portion 122 comprises at least one microphone coupler 140, as shown. Preferably, microphone coupler 140 comprises a rectangular U-shaped portion 142 with a faceplate 148, highly preferably, at least one substantially arcuate faceplate 148 extending from end 144 to end 146, as shown. Preferably, a pass-through aperture 150 (open on both ends) is formed from the above arrangement of rectangular U-shaped portion 142 and faceplate 148, as shown (this arrangement at least embodies herein geometry means for permitting the at least one tactical microphone clip to be clipped from at least two sides of said aperture means). Preferably, the rear coupler 138 (see FIG. 5), couples the tactical microphone 112 to the pass-through aperture 150. Preferably, pass-through aperture 150 allows for either right or left-handed users to couple the tactical microphone 112 to either side of the pass-through aperture 150. Further, the above arrangement of apertures provides for a user to operate, connect and disconnect such at least one microphone using only one hand regardless of user preference and whether the user is right or left handed.

Preferably, faceplate 148 comprises at least one aperture 160, preferably only one aperture 160, as shown. Preferably, aperture 160 provides another tactical microphone 112 coupling point as the rear coupler 138 may also couple the tactical microphone 112 to the aperture 160 by coupling in a vertical position or either left or right horizontal positions similar to the coupling shown in FIG. 1. As described above, this arrangement provides a microphone support 102 comprising multiple coupling elements onto which microphone 112 may be coupled to.

In operation, it is preferred to attach tactical microphone 112, in at least one user-selected position to button 104 by sliding button 104 into slot 126 and upward to the upper slot end until microphone support 102 is hanging from button 104, then, connect microphone 112 to microphone support 102, preferably by coupling coupler 138 to aperture 150 or aperture 160. This arrangement at least embodies herein a method of attaching at least one portable microphone, in at least one user-selected position to at least one normally usable button on such user's clothing, comprising the steps of: providing at least one hanger having at least one upper slot end on at least one substantially vertical rigid slotted portion and at least one microphone attachable element below such at least one substantially vertical rigid slotted portion; hanging such at least one hanger on such at least one normally usable button on such user's clothing at such upper slot end; and attaching a portable microphone to such at least one microphone attachable element.

Preferably, faceplate 148 further comprises indicia 173, as shown. Preferably, such indicia 173 may include Trademarks, Logos, advertising indicia, graphical representations, law enforcement indicia, law enforcement identifiers, etc. Preferably, indicia 173 are printed onto faceplate 148. Upon reading this specification, those with ordinary skill in the art will now appreciate that, under appropriate circumstances, considering such issues as user preference, marketing preference, technological advancement, cost, available materials, etc., other indicia such as, for example, engraving, printed, silk screening, etc., may suffice.

Preferably, microphone support 102 may be made from a variety of materials, highly preferred is PVC or ABS plastic. Those with ordinary skill in the art will now appreciate and understand, upon reading this specification and by their understanding the art of manufacture of plastic as described herein, methods of making elastic microphone supports. Upon reading this specification, those with ordinary skill in the art will now appreciate that, under appropriate circumstances, considering such issues as user preference, marketing preference, technological advancement, microphone technology, cost, structural requirements, available materials, etc., other methods and materials for making a microphone support using materials such as, for example, metals, woods, carbon-fiber, synthetics, etc., may suffice.

Figure 6:
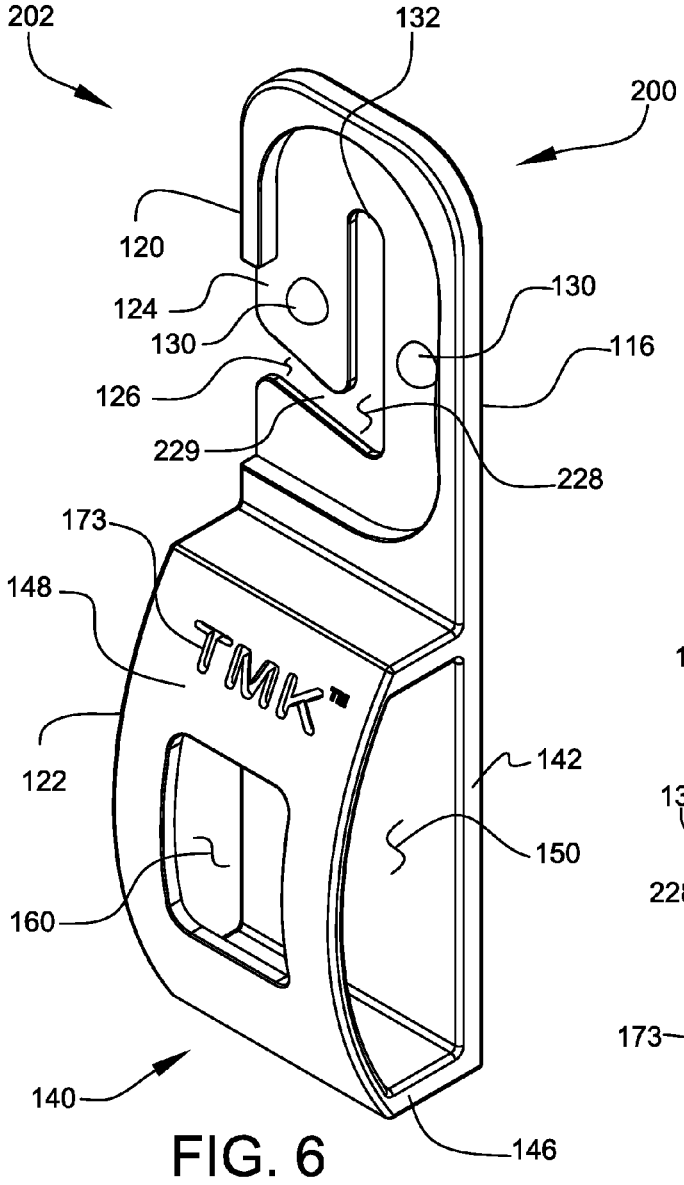
FIG. 6 shows a perspective view, illustrating the tactical microphone support system, according to another preferred embodiment of the present invention.
Figure 7:
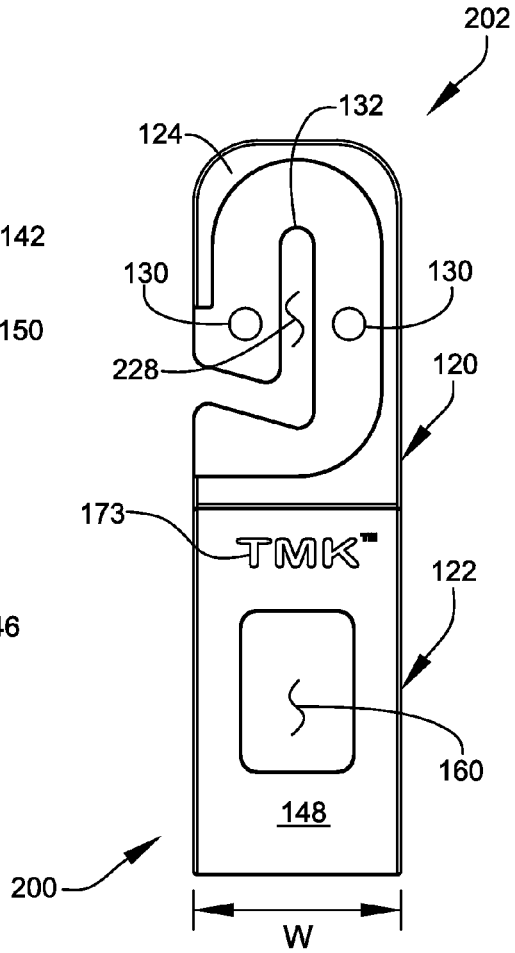
FIG. 7 shows a front-facing view, illustrating the microphone support, according to the preferred embodiment of FIG. 6.

FIG. 6 shows a perspective view, illustrating the tactical microphone support system, according to another preferred embodiment 200 of the present invention. FIG. 7 shows a front-facing view, illustrating the microphone support 202, according to the preferred embodiment of FIG. 6. Preferred embodiment 200 preferably comprises the same structure as embodiment 100 with the exception that slot 126 has an about checkmark-shaped L-slot 228 and, there is preferably an additional button stop 130, to make a total of two button stops 130, as shown. Preferably, about checkmark-shaped L-slot 228 further assists keeping the microphone support 202 from dislodging from button 104 as the checkmark portion angles slightly downward, as shown. Preferably, about checkmark-shaped L-slot 228 comprises about a 25-degree slope for the checkmark portion 229, as shown. In addition, the additional button stops 130 also assist keeping the microphone support 202 from dislodging from button 104. In use, the combination of checkmark-shaped L-slot 228 and two button stops 130, as shown, greatly enhance the probability that an officer in pursuit of a suspect, or during extreme physical exertion, will not lose the tactical microphone 112 from the law enforcement uniform 108.

Figure 8:
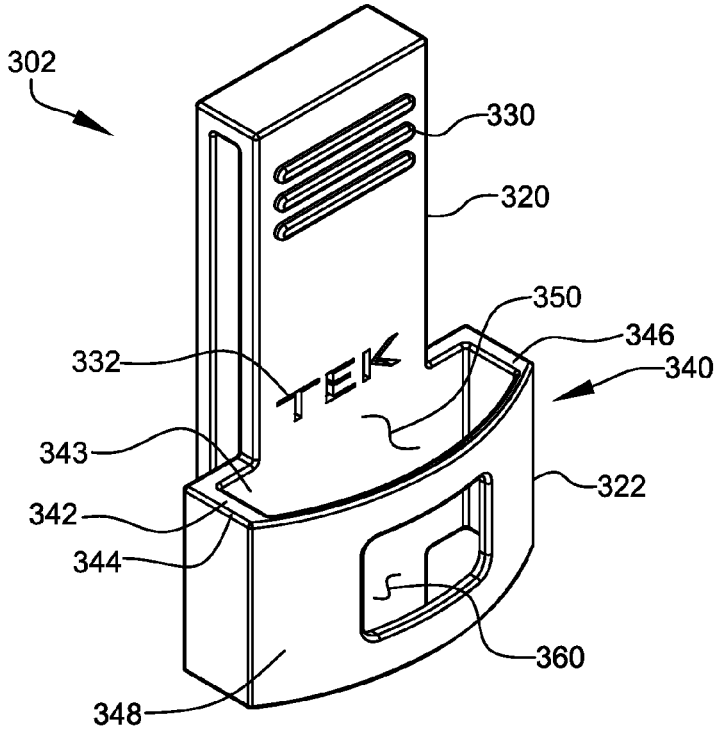
FIG. 8 shows a perspective view, illustrating another microphone support, according to another preferred embodiment of the present invention.

FIG. 8 shows a perspective view, illustrating another tactical microphone support 302, according to another preferred embodiment 300 of the present invention. Tactical microphone support 302 preferably comprises at least one upper portion 320 and at least one lower portion 322 comprising at least one microphone coupler 340, as shown. Tactical microphone support 302 is preferably adapted to hold a tactical microphone 112, (comprising either a fixed or swivel rear coupler 338) while attached to at least one protuberance extending from at least one portion of a law enforcement uniform; such protuberance preferably comprising at least a belt, pocket, epaulette, waistband, etc. Preferably, microphone coupler 340 comprises a rectangular U-shaped portion 342 with a faceplate 348, highly preferably, at least one substantially arcuate faceplate 348 extending from end 344 to end 346, as shown. Preferably, a pass-through aperture 350 (open on both ends) is formed from the above arrangement of rectangular U-shaped portion 342 and faceplate 348, as shown. Preferably, the rear coupler 338 of the microphone 112 (see FIG. 5) comprises a spring clip 339 with a protruding end 336 that assists closure of the spring clip 339 when tightly fitted against the back 341 of the microphone 112. Upon reading this specification, those with ordinary skill in the art will now appreciate that, under appropriate circumstances, considering such issues as design preference, user preferences, marketing preferences, cost, structural requirements, available materials, technological advances, etc., other microphone rear coupler 338 arrangements such as, for example, non-spring tensioned, swivel, adhesive attached, clipped, etc., may suffice. Preferably, the rear coupler 338 of the microphone 112 assists coupling tactical microphone 112 to the pass-through aperture 350. Preferably, pass-through aperture 350 allows for users to couple the tactical microphone 112 to the top 343 of pass-through aperture 350. Preferably, faceplate 348 comprises at least one aperture 360, preferably only one aperture 360, as shown. Preferably, aperture 360 provides another tactical microphone 112 coupling point and further assists complete closure of spring clip 339 when rear coupler 138 couples tactical microphone 112 to aperture 350 (at least embodying herein wherein said clip-hanger means comprises aperture means for permitting at least one support end of said at least one tactical microphone clip to fully close). Further, the above arrangement of apertures provides for a user to operate, connect and disconnect such at least one microphone using only one hand regardless of user preference and whether the user is right or left handed.

Upper portion 320 preferably comprises faceplate 348, as shown. Preferably, faceplate 348 comprises a gripping element 330, preferably to assist a user in gripping the microphone support 302 and placing such microphone support 302 onto at least one protuberance extending from a uniform; such protuberance preferably includes a belt, waistband, epaulette, shirt pocket, etc. Upon reading this specification, those with ordinary skill in the art will now appreciate that, under appropriate circumstances, considering such issues as design preference, user preferences, marketing preferences, cost, structural requirements, available materials, technological advances, etc., other gripping arrangements may suffice.

Faceplate 348 further preferably comprises indicia 332, as shown. Preferably, such indicia 332 may include Trademarks, Logo's, advertising indicia, graphical representations, law enforcement indicia, law enforcement identifiers, etc. Preferably, indicia 332 are printed onto faceplate 348. Upon reading this specification, those with ordinary skill in the art will now appreciate that, under appropriate circumstances, considering such issues as user preference, marketing preference, technological advancement, cost, available materials, etc., other indicia such as, for example, engraving, printed, silk screening, etc., may suffice.

Preferably, microphone support 302 may be made from a variety of materials, highly preferred is PVC or ABS plastic. Those with ordinary skill in the art will now appreciate and understand, upon reading this specification and by their understanding the art of manufacture of plastic as described herein, methods of making elastic microphone support. Upon reading this specification, those with ordinary skill in the art will now appreciate that, under appropriate circumstances, considering such issues as user preference, marketing preference, technological advancement, microphone technology, cost, structural requirements, available materials, etc., other methods and materials for making a microphone support using materials such as, for example, metals, woods, carbon-fiber, synthetics, etc., may suffice.

Figure 9:
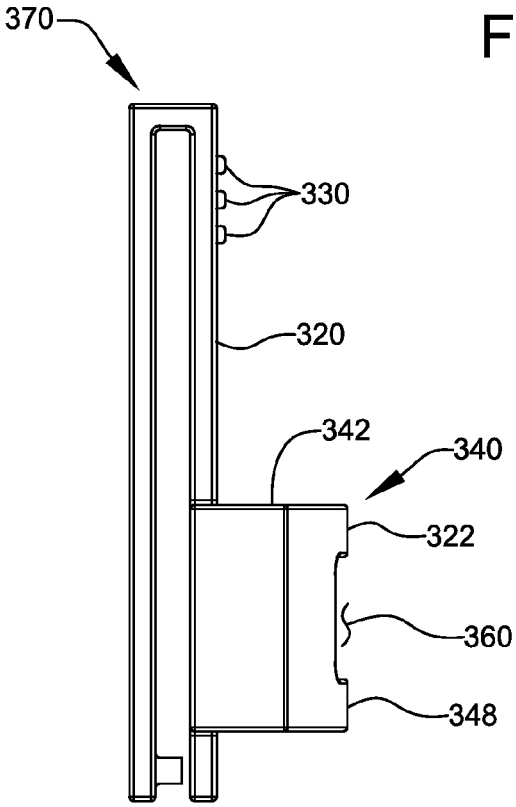
FIG. 9 shows a side view, illustrating a tactical microphone support hanger, according to the preferred embodiment of FIG. 8.

FIG. 9 shows a side view, illustrating tactical microphone support hanger 370, according to the preferred embodiment of FIG. 8. Preferably, upper portion 320, lower portion 322, and microphone coupler 340, are supported by support hanger 370, as shown. Support hanger 370 is preferably adapted to be attached to a relatively thin protuberance 168 extending from a law enforcement uniform 108; such protuberance preferably being at least one epaulette 170 (see FIG. 1).

Figure 10:
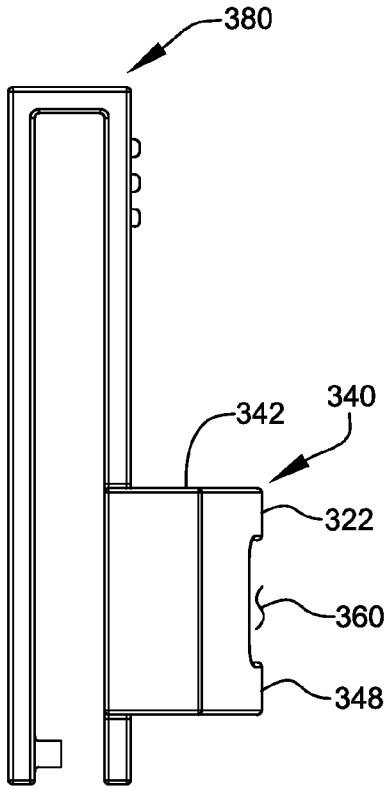
FIG. 10 shows a side view, illustrating another tactical microphone support hanger, according to another preferred embodiment of FIG. 8.

FIG. 10 shows a side view, illustrating another tactical microphone support hanger 380, according to another preferred embodiment of FIG. 8. Preferably, upper portion 320, lower portion 322, and microphone coupler 340, are supported by support hanger 380, as shown. Support hanger 380 is preferably adapted to be attached to a relatively thicker protuberance extending from law enforcement uniform 108; such protuberance preferably being at least one belt 310 (see FIG. 1).

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A communication device support apparatus comprising:

a) at least one support to support at least one communication device; and b) at least one hanger to hang said at least one support from at least one normally usable button wearable by at least one communication device support user;

c) wherein said at least one hanger comprises at least one substantially rigid slot having at least one upper portion supportable by such at least one button wearable by such at least one communication device support user; and d) wherein said at least one substantially rigid slot comprises at least one bayonet slot adapted to bayonet lock said at least one hanger to such at least one normally usable button wearable by the at least one communication device support user.

2. The communication device support apparatus according to claim 1 wherein said at least one bayonet slot comprises one about L-shaped slot structured and arranged to bayonet lock such at least one normally usable button.

3. The communication device support apparatus according to claim 1 further comprising:

a) the at least one communication device;

b) wherein said at least one communication device comprises at least one microphone; and c) wherein said at least one microphone comprises at least one microphone coupler element.

4. The communication device support apparatus according to claim 3 wherein the at least one communication device comprises at least one communication element of at least one law enforcement tactical two-way radio.

5. The communication device support apparatus according to claim 3 wherein said at least one support comprises a plurality of coupling elements onto which said at least one microphone coupler element may be coupled to.

6. The communication device support apparatus according to claim 5 wherein said at least one support comprises at least one arcuate faceplate.

7. The communication device support apparatus according to claim 3 wherein said at least one support comprises at least three apertures structured and arranged to couple to said at least one microphone element.

8. The communication device support apparatus according to claim 7 wherein said at least three apertures are structured and arranged to provide for center, right, or left attachment of said at least one communication device to said at least one support.

9. The communication device support apparatus according to claim 8 wherein said at least one bayonet slot comprises at least one blocking element structured and arranged to block outlet passage of such at least one normally usable button when engaged by said at least one bayonet slot.

10. The communication device support apparatus according to claim 1 wherein said at least one bayonet slot comprises at least one blocking element structured and arranged to block outlet passage of such at least one normally usable button when engaged by said at least one bayonet slot.

11. The communication device support apparatus according to claim 10 wherein said at least one blocking element comprises at least one raised convex bump.

12. The communication device support apparatus according to claim 11 wherein said at least one raised convex bump is situate below such at least one upper portion and closely adjacent said at least one bayonet slot.

13. The communication device support apparatus according to claim 1 wherein a user may operate, connect and disconnect such at least one microphone using only one hand.

14. The communication device support apparatus according to claim 1 wherein said at least one bayonet slot comprises one check-mark-shaped slot structured and arranged to bayonet lock such at least one normally usable button.

15. A communication device support apparatus comprising:

a) at least one support to support at least one communication device; and b) at least one hanger to hang said at least one support from at least one normally usable button wearable by at least one communication device support user;

c) wherein said at least one hanger comprises at least one substantially rigid slot having at least one upper portion supportable by such at least one button wearable by such at least one communication device support user; and d) wherein said at least one substantially rigid slot comprises at least one blocking element structured and arranged to block outlet passage of such at least one normally usable button when engaged by said at least one substantially rigid slot.

16. The communication device support apparatus according to claim 15 wherein said at least one blocking element comprises at least one raised convex bump.

17. The communication device support apparatus according to claim 16 wherein said at least one raised convex bump is situate below such at least one upper portion and closely adjacent said at least one bayonet slot.

18. The communication device support apparatus according to claim 15 wherein said at least one substantially rigid slot comprises at least one bayonet slot adapted to bayonet lock said at least one hanger to such at least one normally usable button wearable by the at least one communication device support user.

19. The communication device support apparatus according to claim 18 wherein said at least one bayonet slot comprises one about L-shaped slot structured and arranged to bayonet lock such at least one normally usable button.

20. The communication device support apparatus according to claim 18 wherein said at least one bayonet slot comprises one check-mark-shaped slot structured and arranged to bayonet lock such at least one normally usable button.

21. The communication device support apparatus according to claim 15 further comprising:

a) the at least one communication device;

b) wherein said at least one communication device comprises at least one microphone; and c) wherein said at least one microphone comprises at least one microphone coupler element.

22. The communication device support apparatus according to claim 21 wherein a user may operate, connect and disconnect such at least one microphone using only one hand.

23. The communication device support apparatus according to claim 21 wherein the at least one communication device comprises at least one communication element of at least one law enforcement tactical two-way radio.

24. The communication device support apparatus according to claim 21 wherein said at least one support comprises a plurality of coupling elements onto which said at least one microphone coupler element may be coupled to.

25. The communication device support apparatus according to claim 24 wherein said at least three apertures are structured and arranged to provide for center, right, or left attachment of said at least one communication device to said at least one support.

26. The communication device support apparatus according to claim 24 wherein said at least one support comprises at least one arcuate faceplate.

27. The communication device support apparatus according to claim 21 wherein said at least one support comprises at least three apertures structured and arranged to couple to said at least one microphone element.

* * * * *